US007872226B2

(12) United States Patent
Höhndorf et al.

(10) Patent No.: US 7,872,226 B2
(45) Date of Patent: Jan. 18, 2011

(54) METHOD AND APPARATUS FOR ADJUSTING A SAMPLE-ION SOURCE ELECTRODE DISTANCE IN A TOF MASS SPECTROMETER

(75) Inventors: Jens Höhndorf, Bremen (DE); Andreas Haase, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 429 days.

(21) Appl. No.: 11/970,108

(22) Filed: Jan. 7, 2008

(65) Prior Publication Data

US 2008/0191131 A1 Aug. 14, 2008

(30) Foreign Application Priority Data

Feb. 13, 2007 (DE) ..... 10 2007 006 933

(51) Int. Cl.
*H01J 49/00* (2006.01)

(52) U.S. Cl. ..... 250/288; 250/281; 250/282; 250/286; 250/287

(58) Field of Classification Search ..... 250/281, 250/282, 287, 286, 288
See application file for complete search history.

(56) References Cited

U.S. PATENT DOCUMENTS 5,910,656 A 6/1999 Koster et al.
7,365,310 B2 4/2008 Truche et al.
2005/0045815 A1* 3/2005 Bui ..... 250/282
2006/0247863 A1 11/2006 Bui
2006/0278824 A1 12/2006 Truche et al.
2006/0284078 A1 12/2006 Overney

FOREIGN PATENT DOCUMENTS

DE 291 455 A7 7/1991
DE 20 2004 005 191 U1 9/2005
JP 2007257851 A 3/2006
WO WO 02/095362 A2 11/2002

* cited by examiner

*Primary Examiner*—Jack I Berman
*Assistant Examiner*—Hanway Chang
(74) *Attorney, Agent, or Firm*—Law Offices of Paul E. Kudirka

(57) ABSTRACT

In a time-of-flight mass spectrometer having an ion source with a first accelerating electrode, a distance between the surface of a sample and the first accelerating electrode is maintained at a predetermined distance which is critical for determining the mass and quantity of ions generated by the ion source. A digital image of the sample surface is obtained with a digital camera and a predetermined characteristic of the digital image is determined. The predetermined characteristic is then used to compute an adjustment amount by which the sample surface is moved to maintain the predetermined distance. Determining the predetermined characteristic can be simplified by projecting a light pattern onto the sample surface at an angle and determining the predetermined characteristic from the digital image of the pattern.

17 Claims, 3 Drawing Sheets

METHOD AND APPARATUS FOR ADJUSTING A SAMPLE-ION SOURCE ELECTRODE DISTANCE IN A TOF MASS SPECTROMETER

BACKGROUND

This invention relates to the precise determination of masses and quantities of analyte ions in high-resolution time-of-flight mass spectrometers in which analyte ions are generated from a sample located on a movable sample support. The sample can be ionized by matrix-assisted laser desorption (MALDI), for example.

Various methods can be used to ionize analyte substances on the surface of a sample support. These include ion bombardment (secondary ion mass spectrometry=SIMS), laser desorption (LD), shock wave generation in the sample support and plasma desorption (PD), which is triggered by high-energy fission particles. The most widely used method is to ionize specially prepared samples on surfaces by means of matrix-assisted laser desorption (MALDI). Whatever method is used, the ions generally have a non-negligible velocity with a large spread around an average velocity on leaving the surface.

Performing such a method with direct axial injection into a time-of-flight mass spectrometer requires a pulsed ion generation with subsequent acceleration of the ions by electric drawing fields. The average initial velocity, which is usually roughly the same for ions of all masses, leads to a non-linear distortion of the essentially linear relationship between the square root of the mass and the flight time from ion generation to ion detection. The spread of initial velocities leads to a broadening of the signals of the individual ion masses and hence to a poor mass resolution; there are, however, methods which diminish this broadening.

In the following, we deal in particular with the ionization of organic analyte molecules by matrix-assisted laser desorption (MALDI), but the conclusions and solutions to the problems shall not be limited to this method alone.

The MALDI method involves applying the analyte molecules together with a large surplus of matrix substance to a sample support and embedding the analyte molecules, molecularly separated, into a crystalline layer of the low-molecular matrix substance. The substances are usually applied in solution and then dried. The term "sample" is used here to describe the prepared and dried mixture of analyte molecules and matrix substance crystals on the sample support. A pulse of light in the order of a nanosecond in duration from a laser focused onto the sample surface vaporizes a small amount of the matrix substance in a quasi-explosive process, forming a plasma, the analyte molecules also being transferred into the initially tiny plasma cloud.

The plasma cloud expands into the vacuum and its adiabatic expansion accelerates not only the relatively light molecules and ions of the matrix substance, but also, by viscous entrainment, the generally much heavier molecules and ions of the analyte substance, which thus obtain kinetic energies higher than would correspond to thermal equilibrium. Even without an accelerating field, the ions reach average velocities of around 500 to 1000 meters per second, depending on the energy density of the laser beam. The velocities are largely independent of the mass of the ions, but have a large velocity spread from around 200 to 2000 meters per second. It is assumed that the neutral molecules of the plasma cloud also possess these velocities.

The ions are accelerated in the ion source by electric fields to energies of around 10 to 30 kiloelectronvolts, injected axially into the flight path of the mass spectrometer and detected time-resolved at the end of the flight path, because heavy ions fly slower than light ions. It is generally not sufficient to acquire only one time-of-flight spectrum. As a rule, several hundred laser shots are used to acquire several hundred individual time-of-flight spectra, the digitized ion current values of which are added together in an electronic data storage device. If the maximum times of flight are each around one hundred microseconds and the measuring and digitization rates are several gigahertz, the data storage device must hold several hundred thousand ion current values. Nowadays, the measuring rates lie between two and eight gigahertz. The ion signals for the measured ion species then form a value sequence of the digitized ion currents in the storage device. The heights of the ion signals and their exact times of flight, with a precision of a fraction of a nanosecond, can be determined with the aid of computer programs using so-called peak recognition procedures.

The mass-to-charge ratios of the ion signals can be determined from their times of flight. Since this type of ionization provides practically only singly charged ions, the term "mass determination" is mostly used below in preference to "determination of the mass-to-charge ratio". The times of flight are converted to masses by means of a mathematical function termed a "calibration curve" below; the result is a mass spectrum with a calibrated "mass scale". The mass spectrum is usually represented as a list of the values of the masses and the signal heights of the ion currents; but a "mass spectrum" may also be understood as a drawing with the intensities plotted over the mass scale. The calibration curve is determined with the aid of a calibrating substance, the ion masses of which are accurately known. This process is called "calibration of the mass scale" of the time-of-flight spectrometer. The calibration curve can be filed in the memory of the data processing system as a series of time-of-flight/mass value pairs, or can be stored as parameter values for a function given mathematically as a formula.

When the plasma cloud is formed, a minute fraction of the molecules, both matrix and sample molecules, is ionized. As the plasma cloud expands, however, more ion/molecule reactions occur, which continuously ionize the large analyte molecules at the expense of the smaller matrix ions. The large spread of velocities and the time-smeared ion formation process adversely affect and limit the mass resolution both in linear and in energy-focusing, reflecting time-of-flight mass spectrometers. A spread of initial velocities alone could be focused out with the energy-focusing reflector, but not the ions which are generated in a certain time period.

One method for increasing the mass resolution under these conditions is known as "delayed extraction" (DE). The ions of the cloud are first made to fly for a brief time in the order of a hundred nanoseconds in a field-free space in front of the sample. This forms a strictly valid correlation between the velocity of the ions and their distance from the sample plate; the velocity distribution of the ions results in a correlated spatial distribution. Only then is the acceleration of the ions by a homogeneous accelerating field, i.e., with a linearly decreasing acceleration potential, switched on. The faster ions are then further away from the sample support electrode and thus at a somewhat lower acceleration potential, which imparts to them a slightly lower final velocity for the drift region of the time-of-flight spectrometer than the ions which were slower at the beginning. If the time lag and the strength of the accelerating field are chosen correctly, ions which are slower to begin with but faster after acceleration can catch up again with the ions that were faster at the beginning but slower after acceleration exactly at the detector (or at an intermediate focus which is then imaged onto the detector). Ions of different masses are thus dispersed at the detector according to their mass, but ions of the same mass are focused primarily with respect to their time of flight. This produces a high mass resolution in the time-of-flight spectrometer, especially in time-of-flight spectrometers with additional energy-focusing reflectors.

The total accelerating voltage does not have to be switched when the accelerating field in front of the sample support is switched on. The total accelerating voltage is around 20 to 30 kilovolts. Even today, it is still technically difficult and very expensive to switch such high voltages in extremely short times amounting to only a few nanoseconds. It is sufficient to switch a relatively small partial voltage if an intermediate electrode is incorporated into the acceleration region. Then, all that is required is for the space between the sample support electrode and the intermediate electrode to be field-free initially and switched over to an accelerating field after a delay. Since the potential drop is essentially predetermined, only low voltages of a few hundred volts need to be switched if the distance between the sample support and the intermediate electrode is correspondingly only a few millimeters wide. The expansion of the vapor plasma cloud in the field-free space means the lower limit for this distance is around one millimeter, but this is scarcely possible for practical designs of ion sources.

It has been shown experimentally that high mass resolution can be achieved with MALDI ionization. Using short laser pulses around half a nanosecond and small focus spot diameters in the order of five micrometers, mass resolutions $m/\Delta m=R=50\ 000$ can be obtained, where $\Delta m$ is the signal width at half height. As a rule of thumb, the mass m can be derived from the signal with a precision of about $\Delta m/20$, a mass precision in the order of one millionth appears to be achievable.

The primary reasons for seeking to achieve a high mass resolution are to obtain a good mass precision and to see that the peaks are not being affected by superpositions; but the high mass resolution also serves to increase the signal-to-noise ratio and hence to increase the sensitivity. Nowadays, good MALDI time-of-flight mass spectrometers aim to produce mass accuracies of less than five millionths of the mass (ppm=parts per million) and preferable only one millionth. Since the introduction of this method, however, it has become apparent that while it is possible in principle to produce an accurate mass determination, it does not always succeed. The function which describes the mass as a function of the time of flight, i.e., the calibration curve, frequently does not remain constant from sample to sample when the ionization is carried out by MALDI, even if the samples are located on the same sample support plate. For an ion with a mass of 5000 atomic mass units, the calculated mass can vary from spectrum acquisition to spectrum acquisition by several mass units, in the extreme case.

For mass determinations which aim to achieve accuracies in the order of one to five millionths, it has therefore become common practice to correct the masses of the analyte ions by simultaneously measuring the mass of ions of admixed known substances. This process is called "recalibration by internal reference masses". The simplest method involves correcting the mass of an analyte substance by linear extrapolation to an assumed linear relationship between the time of flight and the root of the mass. This method, however, requires that the function between mass and time of flight basically remains almost the same from sample to sample, something which, for reasons as yet unknown, is frequently not the case. Moreover, the method requires that reference substances are admixed to each sample, preferably in concentrations as similar as possible to those of the analyte molecules, but these are generally not known.

Modern sample supports can accommodate a very large number of samples; for example, sample supports with 100, 384 or 1536 samples are in use. The sample supports are hence quite large. Some sample supports in use measure two inches by two inches, but also eight by twelve centimeters. The size means that, when moving the sample support in order to bring one sample after the other into the focus of the laser, the distance between sample support and intermediate electrode also varies slightly. This changes the flight distance of the ions and the potential drop in the first acceleration region between sample support and intermediate electrode. The effect can be dramatic. To illustrate this: in a time-of-flight spectrometer with two meter flight distance, an increase of just one micrometer in the distance amounts to an increase in the flight distance and the time of flight of a half a millionth and hence (because of the quadratic relationship) a full millionth apparent increase in the ion mass. Even if metal sample supports and their sliding guides are manufactured with the highest precision, it is scarcely possible to maintain a distance tolerance of one micrometer. Moreover, modifying the distance to the first accelerating electrode also modifies the accelerating field, which magnifies the effect even further. In both simulations and practical experiments, it has been possible to show that a one micrometer change in the distance result in apparent changes in the masses of around two to four parts per million (ppm).

Moreover, the distance is also critical for the focusing location and focusing spot diameter of the ion beam that is formed. Changing the distance by only 20 micrometers can mean that the changes to the focusing conditions causes the current intensity of the ion beam at the detector to drop off by far more than half already. Furthermore, this also changes the calibration curve in a complicated way, not simply in the form of a homogeneous expansion; therefore a recalibration cannot be done simply with an expansion factor. A multipoint recalibration must be carried out. In addition, the mass resolution becomes markedly worse so that, while recalibration is helpful for a more accurate mass determination, the ideal conditions with respect to sensitivity and mass resolution can no longer be achieved.

Attempts are now being made, particularly for medical applications, to use sample supports only once for reasons of analytical certainty. High-precision metal sample supports are too expensive for this. Instead, electrically conductive plastic material is used to manufacture relatively thin sample supports in a simple process, said supports already being equipped with pre-fabricated matrix layers. In this case, the unavoidable variations in the distance to the first accelerating electrode are nearer to one tenth of a millimeter, resulting in apparent mass changes of several hundred millionths (ppm). This makes it clear that extraordinary measures are required here to attain the desired mass accuracies of one millionth.

The distance of the sample support must therefore be very accurately adjusted. Patent U.S. Pat. No. 5,910,656 A (Köster et al.) suggests a method of adjusting the distance by means of electromechanical actuators in such a way that the flight time of a known reference substance provides the correct mass value given by the predetermined calibration curve. However, this method again requires that reference substances of known masses are admixed with the samples in addition to the analyte substances. This admixing is frequently difficult since the concentration used must be roughly the same as the concentration of the analyte substance; but the latter's concentration is unknown. It is therefore almost impossible to carry out this method correctly.

Moreover, with the method suggested, the actual acquisition of the mass spectrum which can be used for an analysis must be preceded by at least one spectrum acquisition to adjust the distance. This uses more of the sample, which is sometimes very valuable and in short supply. The mass spectrum to adjust the distance must also be evaluated by appropriate software programs and this is more time-consuming. If the initial distance is out by more than ten micrometers, the first mass spectrum has a much poorer mass resolution, which does not allow an accurate mass determination to be made. It is therefore generally necessary to acquire a further mass spectrum close to the correct distance in order to correctly adjust the distance.

The cited patent also suggests applying a large number of samples without analyte molecules but with reference substances to the sample support in addition to the analyte samples in close spatial proximity. This means the sample support must be able to move at least over short distances in such a way that the distance remains sufficiently constant. It also requires that the preparation provides samples whose crystalline structures all have precisely the same thickness. This is relatively easy to achieve for so-called thin-layer preparations, which have only a single layer of small matrix crystals only around one micrometer thick. The small crystals here all lie next to each other on the sample support plate. Yet whether or not a thin layer can be produced depends on the matrix substance and its crystallization properties. Many matrix substances do not crystallize easily on the surface of the sample support, but form crystal conglomerates, which can quite easily be 10 to 50 micrometers thick, growing one on top of the other; it is practically impossible to maintain the thickness from sample to sample to within roughly one micrometer accurately here.

Furthermore, in some MALDI time-of-flight mass spectrometers, the laser beam which ionizes the sample is incident at angles of between 30 and 60 degrees. Changing the distance in this case also brings about a transverse shift of the focal point, and hence, particularly with gridless acceleration lenses, a further change to the imaging properties for the ions.

With such thick samples it is sometimes difficult to precisely define the "sample surface", whose distance to the first accelerating electrode must be kept constant, because this sample surface can also resemble an irregularly shaped mountain range. The sample surface in this case shall be taken to mean that part of the sample surface which is precisely at the focus of the laser beam and which is vaporized there.

MALDI time-of-flight mass spectrometers regularly have an ion source which, in addition to an acceleration lens for the ions, also has an optical system to inject the laser light, a digital camera to observe the sample and an associated device to illuminate the sample. The digital camera always observes the sample at an angle of between 30 and 60 degrees to the surface of the sample support plate because the camera or the deflection mirror should not be in the way of the ion beam. The digital camera operates in a macro mode; one digital image contains around two millimeters of sample. The illumination of the sample, which is necessary so the digital camera can take pictures, is also carried out at an appropriate illumination angle. The digital camera images are generally transferred to the computer of the mass spectrometer so they can be viewed on its screen.

MALDI ion sources are available in embodiments with and without grids. Ion sources with accelerating electrodes in the form of grids must also allow the laser beam and the sample illumination to pass through the grid and the digital camera observation must also be done through the grid. Gridless ion sources contain accelerating electrodes which incorporate apertures for these light-optical devices in addition to an aperture to admit the ion beam.

SUMMARY

The invention consists of adjusting the distance between the sample surface and the first accelerating electrode using the knowledge of the position of the sample surface (relative to the digital camera) as determined by an evaluation of images of the digital camera.

If the sample surface is flat and offers a visible structure, the position of the line of best focus across the image of a camera looking at the sample at a non-perpendicular viewing angle already represents a measure for the position of the sample surface and can be used to adjust the distance. Alternatively, an optical projection system which directs light at a non-perpendicular projection angle can be used to project an easily recognizable pattern onto the sample surface; and the lateral displacement of the projected pattern, resulting from a change in the distance between the sample surface and the first accelerating electrode, can be analyzed and used for the adjustment.

With a rigidly mounted digital camera (and a rigidly mounted optical projection system), the position of the line of best focus or the position of the projected pattern in relation to the edges of the digital image is a measure of the distance of the sample surface from the first accelerating electrode. A calibration can be carried out very simply by acquiring mass spectra at different distances of the sample support plate. The analysis of the mass spectra for best mass resolution and sensitivity can be used to determine the best possible position of the line of best focus or the best possible position of the pattern in the digital image and to adjust the distance in the future.

This method makes it possible, in the case of thin-layer preparations with matrix crystals of the order of magnitude of only one micrometer in size arranged flat on the surface, to adjust the distance with an accuracy of around two to four tenths of a micrometer. Thin-layer preparations of this type are used frequently, particularly for peptide analysis; metal or plastic sample supports with pre-prepared matrix crystal thin layers are commercially available. All that is needed for these level thin-layer preparations is a device to precisely adjust the distance, a device to project an easily recognizable pattern at an angle, if used, and software to analyze the images from the digital camera. Electronic devices to transfer the digitally recorded camera images into the computer of the mass spectrometer are generally already available.

For matrix materials which cannot be prepared as thin layers, this method of image analysis must be modified slightly and combined with a voltage control. It is then necessary to determine the thickness of the crystal layer, for which purpose the pattern projected at an non-perpendicular projection angle must be measured at two points, once on the sample support plate as close to the sample as possible, and once on the sample itself. The surface of the sample is then lined up so that it is at the correct distance to the first accelerating electrode and the voltage across the sample support plate is also increased so that the correct, calibrated potential to accelerate the ions is present precisely on the surface of the sample.

Figure 1:
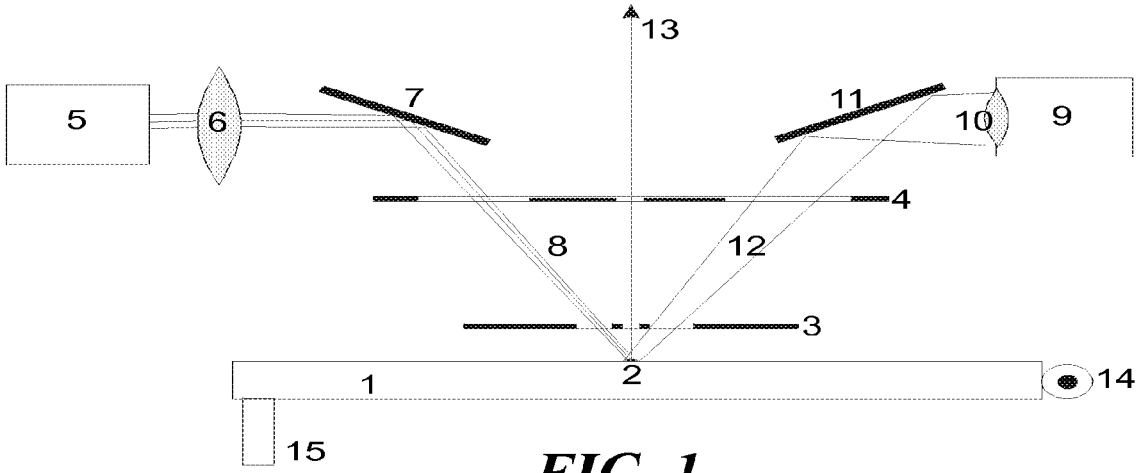
FIG. 1 shows a schematic arrangement with an optical projection system (5, 6) which directs a patterned light beam (8) at a non-perpendicular incidence angle onto sample (2)

and a digital camera (9, 10) which records an image of the sample (2) on a sample support plate (1) under a similar angle. The distance between the surface of the sample (2) and the first accelerating electrode (3) can be adjusted by a movement device (15) connected to a pivot (14). The beam paths (8) for the projection device (5, 6) and (12) for the digital camera (9, 10) are each deflected by mirrors (7) and (11) respectively in order to create an undisturbed beam path (13) for the accelerated ions. The field-free flight path of the ions begins at the second accelerating electrode (4), which is at ground potential.

Figure 2:
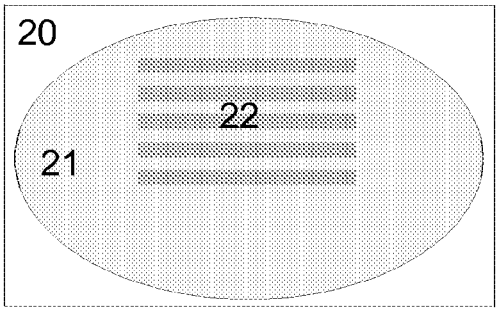
Figure 3:
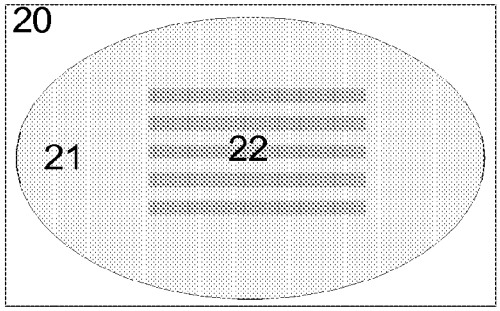
Figure 4:
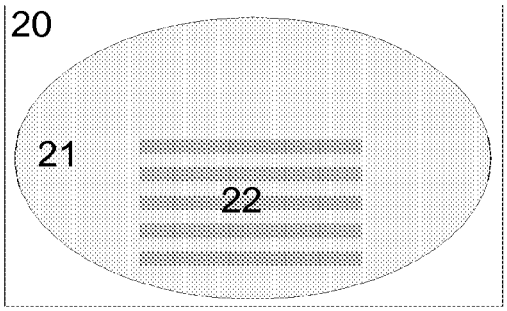

FIGS. 2, 3 and 4 are schematic representations of the digital images (20) of a round sample (21) around two millimeters in diameter, which were obtained with a thin layer preparation and onto whose surface a grid (22) is projected. The sample support plate is moved laterally so that each of the samples is moved into the middle of the image, but the position of the grid in the image indicates whether the distance to the first accelerating electrode is maintained. Only in FIG. 3 is the distance correct; in FIG. 2 the distance is too small and in FIG. 4 too large. The correct distance is obtained by adjusting the projection so that the grid is in the middle of the image.

Figure 5:
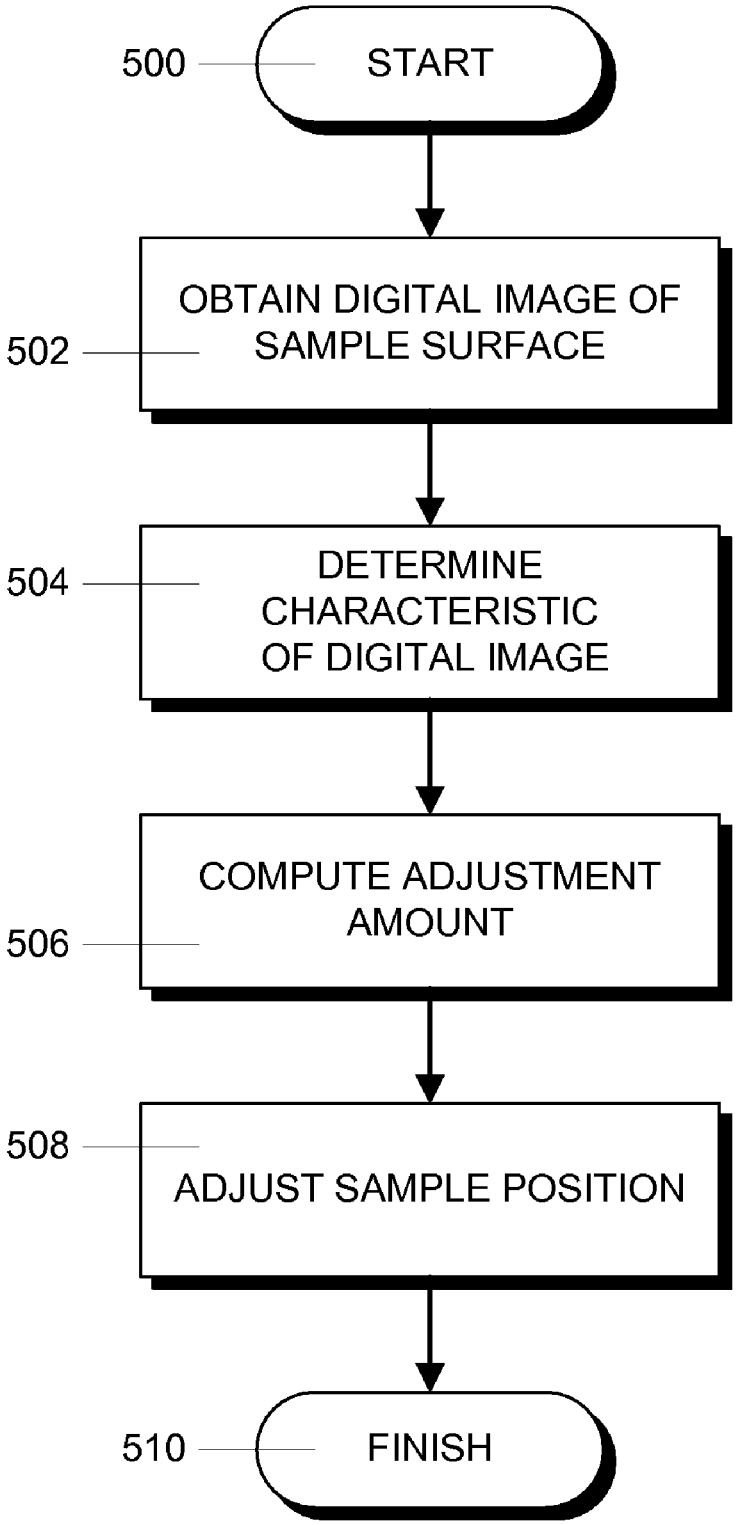

FIG. 5 is a flowchart showing the steps in an illustrative method for adjusting the position of the sample to maintain a constant distance from the sample surface to the first accelerating electrode of the ion source.

Figure 6:
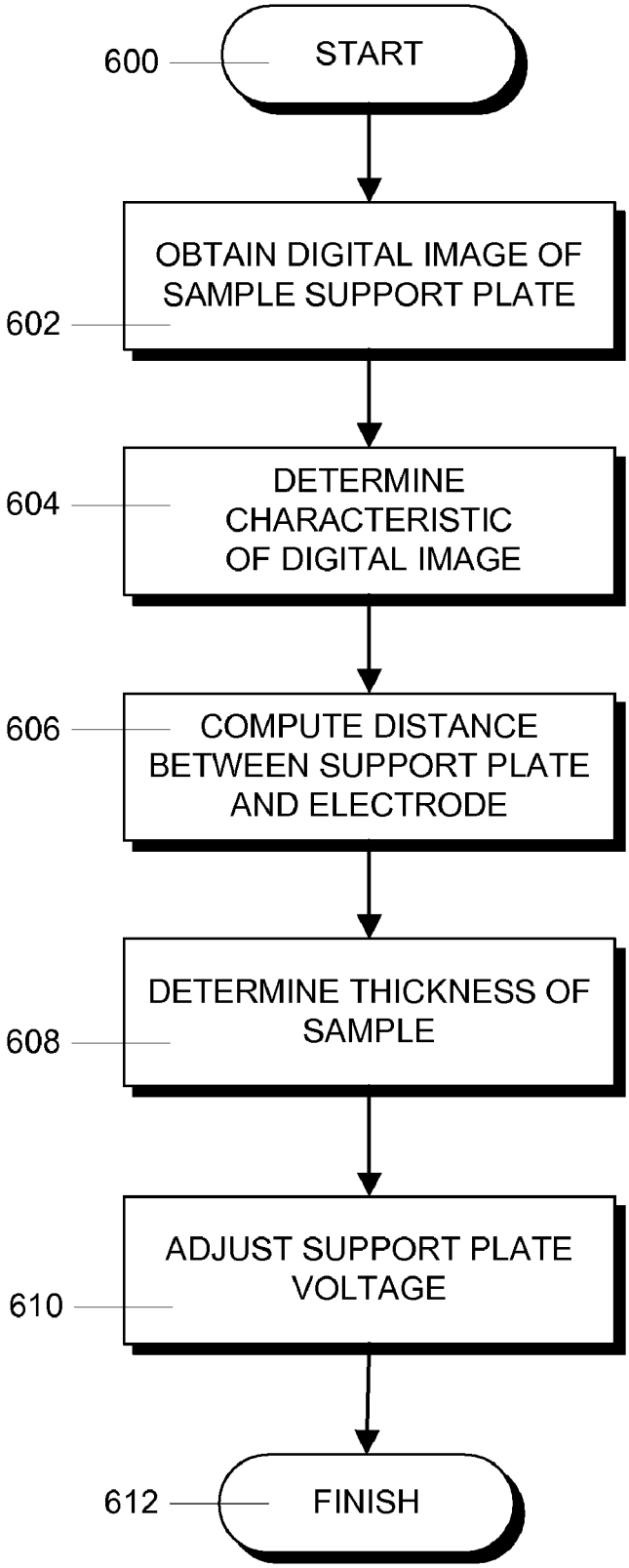

FIG. 6 is a flowchart showing the steps in an illustrative method for determining sample thickness and adjusting the sample plate voltage to account for sample thickness.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

The steps involved in the inventive method are shown in FIG. 5. This process starts in step 500 and proceeds to step 502 where a digital image of the sample surface is obtained with a convention digital camera and stored in a conventional manner for processing. The digital camera is rigidly mounted at a non-perpendicular angle with respect to the sample surface. In step 504, the digital image produced by the camera is processed to extract a predetermined characteristic. In a simple embodiment of the invention, the sharpness distribution across the camera image of the sample recorded in oblique plan view (it is also possible to analyze the contrast instead of the sharpness) is the predetermined characteristic. This method requires the sample to have a flat surface with a visible structure. This is regularly the case with thin-layer preparations because the individual small crystals of this preparation appear in the digital camera spatially resolved. The camera views the sample at a non-perpendicular incidence angle and provides a line of best focus right across the image, and the position of this line in the screen of the stationary camera provides a measure for the distance from the sample surface. In step 506, this position is used by software which evaluates the camera images to compute an adjustment amount. The software for evaluating the camera images must be able to recognize this line of best focus. In step 508, the adjustment amount is used to adjust the sample surface—electrode distance and the process finishes in step 510.

Particularly favorable is a modified method, the apparatus for which is shown in FIG. 1, wherein an optical projection system (5) which directs light at a non-perpendicular incidence angle with lens (6) projects an easily recognizable pattern onto the sample (2). The projection can preferably be performed at an angle of around 45°, as shown in FIG. 1, but a large range of angles from around 15° to 75° is also permissible. Changing the distance of the sample surface (2) brings about a lateral displacement of the pattern, as shown in FIGS. 2, 3 and 4. This displacement is easy to analyze and can be used as a means of adjustment. The pattern can be a round spot or a rectangle, for example, the position of the central point of which can easily be determined in the digital camera image. Another particularly good option is a light-dark pattern (22) comprising an arrangement of several parallel lines, as selected in FIGS. 2, 3 and 4. The lines should be arranged so that they are parallel to the edges of the image. The optical projection system can operate with light-emitting diodes, but operates particularly well with laser diodes. If laser diodes are used, a favorable width for the lines and the spaces between the lines is around 100 micrometers because, in this case, the speckle formation can be readily averaged; this means the position of the irradiated sample surface can be readily and quickly determined to within two to four tenths of a micrometer, resulting in a mass precision of less than one part per million. It has proven successful to carry out the evaluation by means of a Fourier analysis of the pixel values with a fast Fourier transformation (FFT). A two-dimensional Fourier transformation, or after summing the pixel values along the lines, a one-dimensional Fourier transformation may be used. The evaluation takes only a few hundredths of a second and so hardly extends the time needed for the analytical method. The light-dark pattern of the projection device can also be mixed with normal lighting from a means of illumination, so that it is still possible to observe the samples continuously. The light for the projected pattern may also be modulated, and a phase-locked amplification of the images separates the pattern from illuminating background light.

Arrangements to control the distance of the sample surface (2) from the first accelerating electrode (3) have already been described in the patent cited above; in particular, they can incorporate three identical movement devices for parallel movement of the sample support plate (1). The movement devices can comprise motorized tangent screws or piezoelectric elements in various embodiments. Even temperature-controlled bimetallic elements can be used, although these are usually slightly sluggish in their movement. The three movement elements can also be replaced by two elements or even by a single element if it is possible to guide the sample support plate in a direction at right angles to the surface with a high degree of parallelism.

It has proven possible, however, to use a single movement element (15) for the sample support plate if the latter is connected to a pivot (14) located as far away as possible from the coated sample surface. The pivot (14) can be secured to the sample support plate itself or to its base plate. The sample support plate (1) is usually fastened, with insulators, on a motorized base plate, the base plate being at ground potential, while the sample support plate (1) can be set at a potential of around 30 kilovolts. Experience has shown that the slight change to the angle between the sample surface (2) and the plane of the first acceleration diaphragm (3) has no measurable effect on the quality of the mass spectra. The base plate is located on an x-y movement device which moves the individual samples in the plane of the sample support surface into the focus of the laser.

To adjust the distance of the sample support plate (1) with a combination of a single movement element (15) and a pivot (14) it must be borne in mind that, depending on the position of the sample (2) on the sample support (1), the travel at the point where the sample (2) is located may not be the same as the travel of the movement device (15). There is, however, a proportionality which results from the geometry of the position of the sample (2) on the sample support plate (1), and which is easy to calculate.

As explained above, these methods make it possible, in the case of thin-layer preparations with matrix crystals of the order of a few micrometers in size arranged flat on the surface, to adjust the distance with an accuracy of a few tenths of a micrometer. Thin-layer preparations of this type are used frequently, particularly in peptide analysis; disposable plastic sample supports with pre-prepared matrix crystal thin layers are commercially available for this purpose. In order to manufacture these sample supports at a reasonable price, it is simply not possible to maintain the accuracy requirement for the evenness of the sample surface. The surfaces which hold the samples are around 100 square centimeters in size, after all. It is possible to dismiss the accuracy requirement if the distance between the sample surface and the first accelerating electrode can be adjusted each time.

For these level thin-layer preparations, all that is needed, besides the motorized mechanism for adjusting the distance, is software to analyze the images from the digital camera (9, 10) and, if used, the device (5, 6) to project a pattern at an angle. The pattern projection can be combined with the general illumination of the sample which is needed to record the digital images. Electronic devices to transfer the digitally recorded camera images into the computer of the mass spectrometer are generally already available.

It is more difficult to achieve good adjustment for those matrix materials which cannot be prepared as thin layers. In such cases, it is not only the distance between the sample surface and the first accelerating electrode which must be adjusted, but also the voltage across the sample support farther back if the desired effect of a high-resolution measurement of the ion masses is to be achieved with high precision and accuracy. The method of image analysis shown in FIG. 5 must be modified slightly and combined with a voltage control. It is then necessary to determine the thickness of the non-conductive crystal layer. An illustrative process for determining the thickness is shown in FIG. 6. This process begins in step 600 and proceeds to step 602 where an additional image is obtained (for example, by a pattern projected at an angle) of the sample support plate next to the sample. Then, in step 604 a predetermined characteristic of the digital image is obtained in the same manner as described above with respect to FIG. 5. This predetermined characteristic is then used to compute the distance between the sample support plate and the first accelerating electrode in step 606. From the process described in FIG. 5, the distance of the sample surface from the first accelerating electrode is obtained, and in step 608, these distances are used to determine the thickness of the sample. The surface of the sample is then adjusted as described with respect to FIG. 5 so that it is at a predetermined distance from the first accelerating electrode. Then, in step 610, the voltage across the sample plate is increased so that the correct, calibrated potential to accelerate the ions is present exactly on the surface of the sample. The process then ends in step 612.

A numerical example illustrates this: if the distance between the sample surface and the first accelerating electrode is three millimeters, and if the accelerating voltage between these two surfaces, which is to be switched on after a delay, is 1800 volts (600 volts per millimeter), and if the crystal layer is 50 micrometers thick (1/20 millimeter), then the sample support plate must be switched to a potential which is 30 volts higher than for a thin-layer preparation. The potential on the surface of the crystalline sample is then exactly right and all focusing conditions have been recreated so as to be identical.

The methods according to the invention have outstanding advantages. Even if it is not possible to produce a calibration curve that allows a mass accuracy of a few millionths of the mass (a few ppm) to be achieved without recalibration, it is still possible to come so close to the conditions for the validity of the calibration curve that the subsequent correction can be done using a simple proportionality factor. Furthermore, the conditions for the best mass resolution are maintained from sample to sample.

Moreover, the reproducibility of the intensity of the ion current signal is very good, which is very favorable for quantitative analyses which, until now, have not been possible for MALDI mass spectrometry without reference measurements of marked and unmarked substances in the same sample. By maintaining the most favorable imaging properties for the ions, the maximum sensitivity is also always maintained. This was not possible without an adjustment of this type. It must be remembered that when the distance between the sample surface and the first accelerating electrode is changed by only some 10 to 20 micrometers, the sensitivity already drops to less than 50 percent. This invention therefore makes it possible for the first time to work quantitatively without markings.

What is claimed is:

1. In a time-of-flight mass spectrometer having an ion source with a rigidly mounted digital camera viewing a sample surface at a non-perpendicular viewing angle, a method for adjusting a position of the sample surface to maintain a predetermined distance between the sample surface and a first accelerating electrode of the ion source, the method comprising:

(a) obtaining a digital image of the sample surface with the digital camera;

(b) determining a predetermined characteristic of the digital image;

(c) based on the predetermined characteristic, computing an adjustment amount by which a current distance between the sample surface and the first accelerating electrode differs from the predetermined distance; and (d) adjusting the distance between the sample surface and the first accelerating electrode at the sample position by the adjustment amount.

2. The method of claim 1, wherein step (b) comprises determining a line of best focus in the digital image and step (c) comprises computing the adjustment amount from a position of the line of best focus in the digital image.

3. The method of claim 1, wherein step (a) comprises projecting a pattern onto the sample surface at a non-perpendicular projection angle with a rigidly mounted optical projection system, step (b) comprises locating the pattern in the digital image, and step (c) comprises computing the adjustment amount from a lateral displacement of the pattern in the digital image.

4. The method of claim 3, wherein the projection angle is between 15 and 75 degrees.

5. The method of claim 3, wherein the pattern comprises a spot bounded on all sides and having a central point, and step (b) comprises locating the central point in the digital image and step (c) comprises computing the adjustment amount from a lateral displacement of the central point from a predetermined location in the digital image.

6. The method of claim 3, wherein the pattern comprises parallel lines.

7. The method of claim 6, wherein step (b) comprises determining a location of the pattern in the digital image with a Fourier analysis of the digital image.

8. The method of claim 1, wherein the sample surface is the surface of a sample mounted on a sample support plate and wherein the method further comprises:

(e) obtaining a second digital image of the sample support plate with the digital camera;

(f) determining a second predetermined characteristic of the second digital image;

(g) computing with the second predetermined characteristic, a distance between the sample support plate and the first accelerating electrode;

(h) determining a thickness of the sample from the distance between the sample support plate and the first accelerating electrode and the adjustment amount, and (i) adjusting a voltage at the sample support plate based on the sample thickness.

9. The method of claim 1, wherein the sample surface is the surface of a sample mounted on a sample support plate and wherein step (d) comprises rotating the sample support plate around a pivot with a movement device.

10. An ion source for a time-of-flight mass spectrometer, the ion source having a first accelerating electrode and a sample surface which is movable with respect to the first accelerating electrode and comprising:

a digital camera that is rigidly mounted at a non-perpendicular viewing angle with respect to the sample surface and that generates a digital image of the sample surface;

means for processing the digital image to determine a predetermined characteristic;

a computation mechanism that is responsive to the predetermined characteristic for computing an adjustment amount by which a current distance between the sample surface and the first accelerating electrode differs from a predetermined distance; and a mechanism that adjusts the sample position by the adjustment amount in order to maintain the predetermined distance between the sample surface and the first accelerating electrode.

11. The ion source of claim 10, wherein the means for processing the digital image comprises means for determining a line of best focus in the digital image and wherein the computation mechanism comprises means for computing the adjustment amount from a position of the line of best focus in the digital image.

12. The ion source of claim 10 further comprising a projection apparatus that projects a pattern onto the sample surface at a non-perpendicular projection angle and wherein the means for processing the digital image comprises means for locating the pattern in the digital image, and wherein the computation mechanism comprises means for computing the adjustment amount from a lateral displacement of the pattern in the digital image.

13. The ion source of claim 10, wherein the sample surface is the surface of a sample mounted on a sample support plate and wherein the apparatus further comprises:

means for obtaining a second digital image of the sample support plate with the digital camera;

means for determining a second predetermined characteristic of the second digital image;

means for computing with the second predetermined characteristic, a distance between the sample support plate and the first accelerating electrode;

means for determining a thickness of the sample from the distance between the sample support plate and the first accelerating electrode and the adjustment amount, and means for adjusting a voltage at the sample support plate based on the sample thickness.

14. A time-of-flight mass spectrometer comprising:

an ion source having a first accelerating electrode and a sample surface which is movable with respect to the first accelerating electrode;

a digital camera that is rigidly mounted at a non-perpendicular viewing angle with respect to the sample surface and that generates a digital image of the sample surface;

means for processing the digital image to determine a predetermined characteristic;

a computation mechanism that is responsive to the predetermined characteristic for computing an adjustment amount by which a current distance between the sample surface and the first accelerating electrode differs from a predetermined distance; and a mechanism that adjusts the sample position by the adjustment amount in order to maintain the predetermined distance between the sample surface and the first accelerating electrode.

15. The time of flight mass spectrometer of claim 14, wherein the means for processing the digital image comprises means for determining a line of best focus in the digital image and wherein the computation mechanism comprises means for computing the adjustment amount from a position of the line of best focus in the digital image.

16. The time of flight mass spectrometer of claim 14 further comprising a projection apparatus that projects a pattern onto the sample surface at a non-perpendicular projection angle and wherein the means for processing the digital image comprises means for locating the pattern in the digital image, and wherein the computation mechanism comprises means for computing the adjustment amount from a lateral displacement of the pattern in the digital image.

17. The time of flight mass spectrometer of claim 14, wherein the sample surface is the surface of a sample mounted on a sample support plate and wherein the apparatus further comprises:

means for obtaining a second digital image of the sample support plate with the digital camera;

means for determining a second predetermined characteristic of the second digital image;

means for computing with the second predetermined characteristic, a distance between the sample support plate and the first accelerating electrode;

means for determining a thickness of the sample from the distance between the sample support plate and the first accelerating electrode and the adjustment amount, and means for adjusting a voltage at the sample support plate based on the sample thickness.

* * * * *